US006955357B2

(12) United States Patent
Griffin et al.

(10) Patent No.: US 6,955,357 B2
(45) Date of Patent: Oct. 18, 2005

(54) EXTENDED RANGE VARIABLE BORE RAM PACKER FOR A RAM TYPE BLOWOUT PREVENTER

(75) Inventors: Theodore F. Griffin, Houston, TX (US); Sean L. Gaudette, Katy, TX (US); Anthony P. Foster, Katy, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 10/265,788

(22) Filed: Oct. 7, 2002

(65) Prior Publication Data

US 2004/0066003 A1 Apr. 8, 2004

(51) Int. Cl.[7] ..... E21B 33/06
(52) U.S. Cl. ..... 277/325; 251/1.2
(58) Field of Search ..... 277/324, 325; 251/1.1, 1.2

(56) References Cited

U.S. PATENT DOCUMENTS

| | | | | |
|---|---|---|---|---|
| 2,846,178 A | | 8/1958 | Minor | |
| 3,434,729 A | * | 3/1969 | Vertson et al. | 277/325 |
| 3,897,038 A | | 7/1975 | Le Rouax | |
| 3,917,293 A | | 11/1975 | Lewis et al. | |
| 4,007,904 A | * | 2/1977 | Jones | 251/1.2 |
| 4,089,532 A | * | 5/1978 | Kamyshnikov et al. | 277/325 |
| 4,099,699 A | | 7/1978 | Allen | |
| 4,229,012 A | | 10/1980 | Williams, III | |
| 4,265,424 A | * | 5/1981 | Jones | 251/1.3 |
| 4,444,404 A | | 4/1984 | Parks, Jr. | |
| 4,458,876 A | | 7/1984 | Schaeper et al. | |
| 4,550,895 A | | 11/1985 | Shaffer | |
| 5,064,164 A | * | 11/1991 | Le | 251/1.1 |
| 5,127,623 A | * | 7/1992 | McDugle | 251/1.3 |
| 5,603,481 A | * | 2/1997 | Parker et al. | 251/1.3 |
| 5,833,208 A | * | 11/1998 | Lee, Jr. | 251/1.3 |
| 6,089,526 A | * | 7/2000 | Olson | 251/1.3 |
| 6,296,225 B1 | * | 10/2001 | Watts | 251/1.3 |
| 6,367,804 B1 | * | 4/2002 | Watts | 277/325 |
| 6,554,247 B2 | * | 4/2003 | Berckenhoff et al. | 251/1.3 |

* cited by examiner

*Primary Examiner*—Alison K. Pickard
(74) *Attorney, Agent, or Firm*—Michael Hartmann; Peter Bielinski

(57) ABSTRACT

A variable bore ram packer including a ram body, a top seal and a packer member designed for use in a standard ram-type blowout preventer used in oil and gas drilling operations is disclosed. The packer member is molded of an elastomeric material having a central semi-elliptical opening with a plurality of packer inserts molded within the elastomeric material in a semi-circular pattern around the central semi-elliptical opening of the elastomeric material. The semi-circular pattern of the packer inserts and the semi-elliptical opening of the elastomeric material share a common axis. The packer member and the plurality of packer inserts are molded into a unitary structure allowing the plurality of packer inserts to move and seat against different diameter tubular members to prevent extrusion of the elastomeric material between the packer inserts and the tubular member.

14 Claims, 4 Drawing Sheets

EXTENDED RANGE VARIABLE BORE RAM PACKER FOR A RAM TYPE BLOWOUT PREVENTER

BACKGROUND OF THE INVENTION

1. Field of the Invention

This invention relates to an improvement in variable bore ram packers for a ram-type blowout preventer used in oil and gas drilling operations. The improved ram packer is designed to generate more mobility and uniform movement of the metal inserts that are molded into the ram packer before subjecting the ram packer rubber to full loading. This allows the packer to better seal on the contours of the drill pipe disposed within the bore of the blowout preventer.

Ram-type blowout preventers are part of a pressure control system used in oil and gas drilling operations to control unexpected well bore pressure spikes or "kicks" as they are commonly referred to in the industry. The blowout preventer has a body with a vertical bore and a pair of laterally disposed opposing bonnet assemblies. Each bonnet assembly includes a piston which is laterally moveable within the bonnet assembly by pressurized hydraulic fluid. Replaceable sealing elements called "packers" are mounted within rams attached to the ends of the pistons which extend into the blowout preventer bore. When these pistons are moved to a closed position, commonly referred to as "closing the blowout preventer" or "closing the rams", the vertical bore of the blowout preventer is sealed and the kick is contained. These packers are available in a variety of configurations designed to seal the blowout preventer bore when the opposing rams and pistons are moved to their closed position.

One type of ram with packer has ends designed to seal around pipe of a specific size in the blowout preventer bore when the blowout preventer is closed. Other rams with packers are configured to seal around a range of pipe sizes. It is the type designed to seal around a range of pipe sizes, called variable bore ram packers to which the present invention is directed. The ram packers form a pressure tight seal during a kick until the well bore pressure can be controlled. The well bore pressure can reach several thousand pounds per square inch during a kick. Each ram packer has a semicircular opening in its front face to form a seal around 180° of the outer periphery of the pipe. When the rams are closed as described above, the opposing ram packers meet and seal the entire 360° periphery of the pipe. The novel variable bore ram packer of the present invention is designed to increase mobility and movement of the packer insert array to ensure the metal inserts smoothly and uniformly surround the pipe to be sealed against and eliminate large rubber extrusion gaps in the annulus between the metal insert's central column and the pipe being sealed against.

In an effort to minimize the tearing and loss of mass of the elastomeric sealing element, numerous modifications and additions to the ram packer and particularly the elastomeric sealing element in ram-type blowout preventers have been used. The variable bore ram packer of the current invention offers a substantial improvement by offering a variable bore ram packer with a smoother movement of the metal insert array during closing operations and minimization of rubber extrusion gaps between the metal inserts and the pipe being sealed against.

2. Description of Related Art

The use of metal inserts in a conical-type blowout preventer is disclosed in U.S. Pat. No. 2,846,178 to B. S. Minor.

U.S. Pat. No. 3,897,038 to R. K. Le Rouax shows a ram type blowout preventer using metal inserts as an anti-extrusion means.

The use of metal inserts in an annular blowout preventer to control the stress level in the elastomeric packer unit is shown in U.S. Pat. No. 3,917,293 to G. E. Lewis et al.

U.S. Pat. No. 4,099,699 to H. Allen shows the use of irising metal inserts in an annular blowout preventer.

Another example of metal inserts in a variable bore blowout preventer in disclosed in U.S. Pat. No. 4,229,012 to B. C. Williams, III.

U.S. Pat. No. 4,444,404 to G. C. Parks, Jr. shows an example of a variable bore ram packer with interlocking anti-extrusion metal inserts.

Another example of a variable bore ram packer with interlocking anti-extrusion metal inserts is disclosed in U.S. Pat. No. 4,458,876 to G. R. Schaeper et al.

U.S. Pat. No. 4,550,895 to D. U. Shaffer shows an early version of a variable bore ram packer. This apparatus utilizes a plurality of annular segments embedded in the elastomeric rubber to aid in effectuating a seal.

U.S. Pat. No. 6,367,804 B1 to G. D. Watts discloses variable bore ram packer utilizing a pillar insert with top and bottom plates that are rotatable with respect to one another to allow sealing on taper tool joint connections.

SUMMARY OF THE INVENTION

The variable bore ram packer of the present invention is designed for use in a standard ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The variable bore ram packer includes a ram body, a top seal and a packer member. The packer member is molded of an elastomeric material having a central semi-elliptical opening sized to fit closely about a tubular member when the blowout preventer is closed. The packer member includes a plurality of packer inserts molded within the elastomeric material in a semi-circular pattern around the central semi-elliptical opening of the elastomeric material. The semi-circular pattern of the packer inserts and the semi-elliptical opening of the elastomeric material share a common axis. The packer member and the plurality of packer inserts are molded into a unitary structure allowing the plurality of packer inserts to move and seat against different diameter tubular members to prevent extrusion of the elastomeric material between the packer inserts and the tubular member.

The packer inserts include a top plate, a bottom plate and a central web positioned therebetween and integrally formed therewith. The top and bottom plates are a substantially triangular shape and each of the top and bottom plates includes a guide lip and a guide shoulder. The guide lips and guide shoulders of adjacent top plates and the guide lips and guide shoulders of adjacent bottom plates coact to provide an irising motion to the top and bottom plates as the top and bottom plates move and seat against different diameter tubular members. The simultaneous movement of the top and bottom plates of the insert allows the top and bottom plates to move and seat against the tubular member.

A principal object of the present invention is to provide a variable bore ram packer that is designed to increase mobility and movement of the packer metal insert array to ensure the metal inserts smoothly and uniformly surround the pipe to be sealed against and eliminate large rubber extrusion gaps in the annulus between the metal insert's central column and the pipe being sealed against.

Another object of the present invention is to provide a variable bore ram packer that will reliably allow sealing over a wider range of tubular member diameters than has been available in the past.

A final object of the present invention is to provide a variable bore ram packer that can maintain a seal against different sized tubular members while minimizing damage to the elastomeric sealing element of the packer.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PRESENTLY PREFERRED EMBODIMENT

Figure 1:
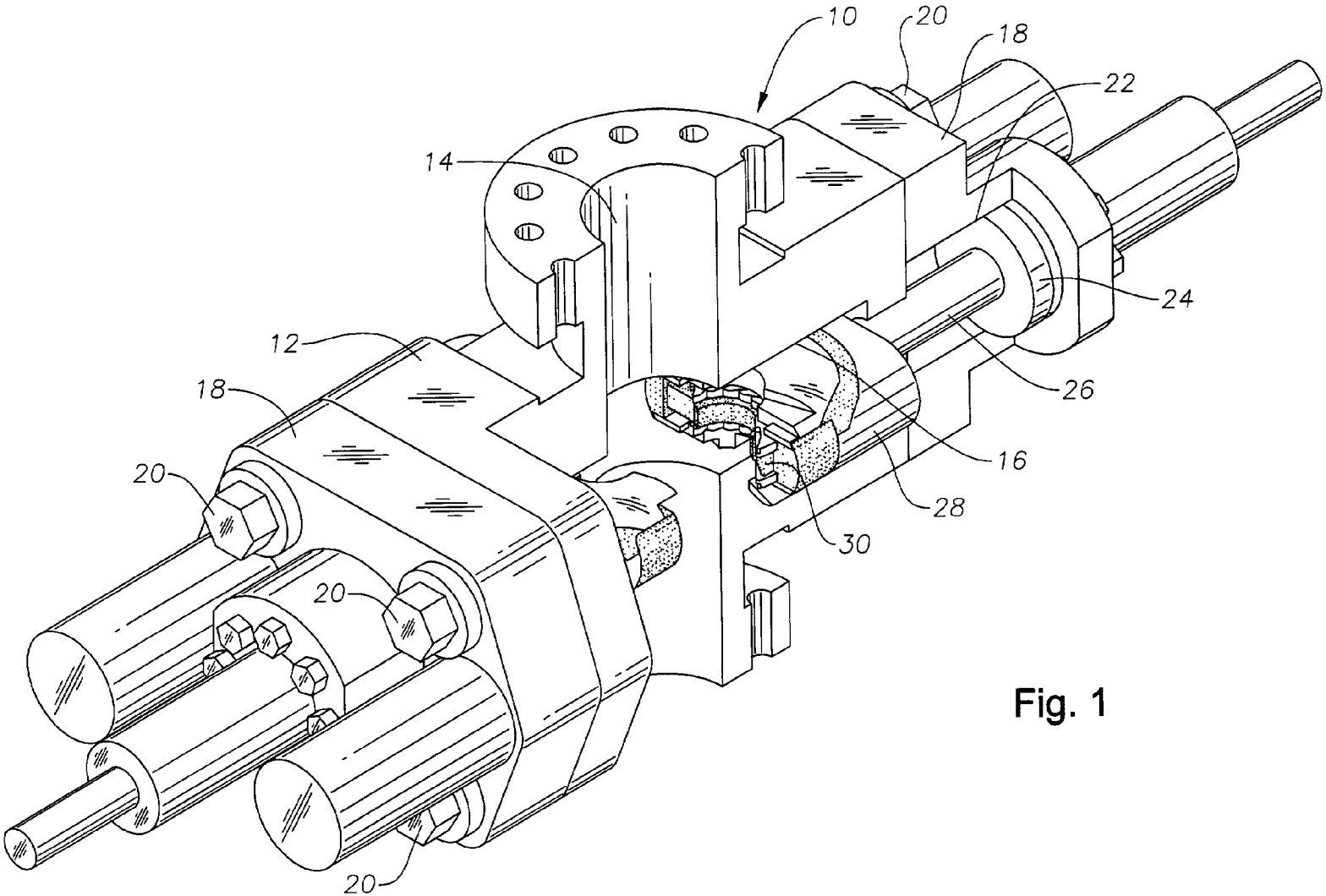
FIG. 1 is a perspective view illustrating a cutaway section of a typical ram-type blowout preventer used in oil and gas drilling operations with the variable bore ram packer of the present invention shown installed within.

With reference to the drawings, and particularly to FIG. 1, an isometric view of a ram type blowout preventer 10 used in oil and gas drilling operations is shown. The ram type blowout preventer 10 includes a body or housing 12 with a vertical bore 14 and laterally disposed ram guideways 16. Bonnet assemblies 18 are mounted to the body 12 with suitable securing means such as studs or bolts 20 and aligned with laterally disposed guideways 16. Each bonnet assembly 18 includes an actuation means 22, including a piston 24 and connecting rod 26. While only one guideway 16 and actuation means 22 is shown, it is understood by those of ordinary skill in the art that there is a pair of opposed guideways 16 and actuation means 22. Each connecting rod 26 is connected to a ram 28 which includes the variable bore ram packer 30 of the present invention. Actuation means 22 allows ram 28 and variable bore ram packer 30 to be reciprocated within guideways 16 or "opening and closing the rams" as it is referred to in the industry.

Figure 2:
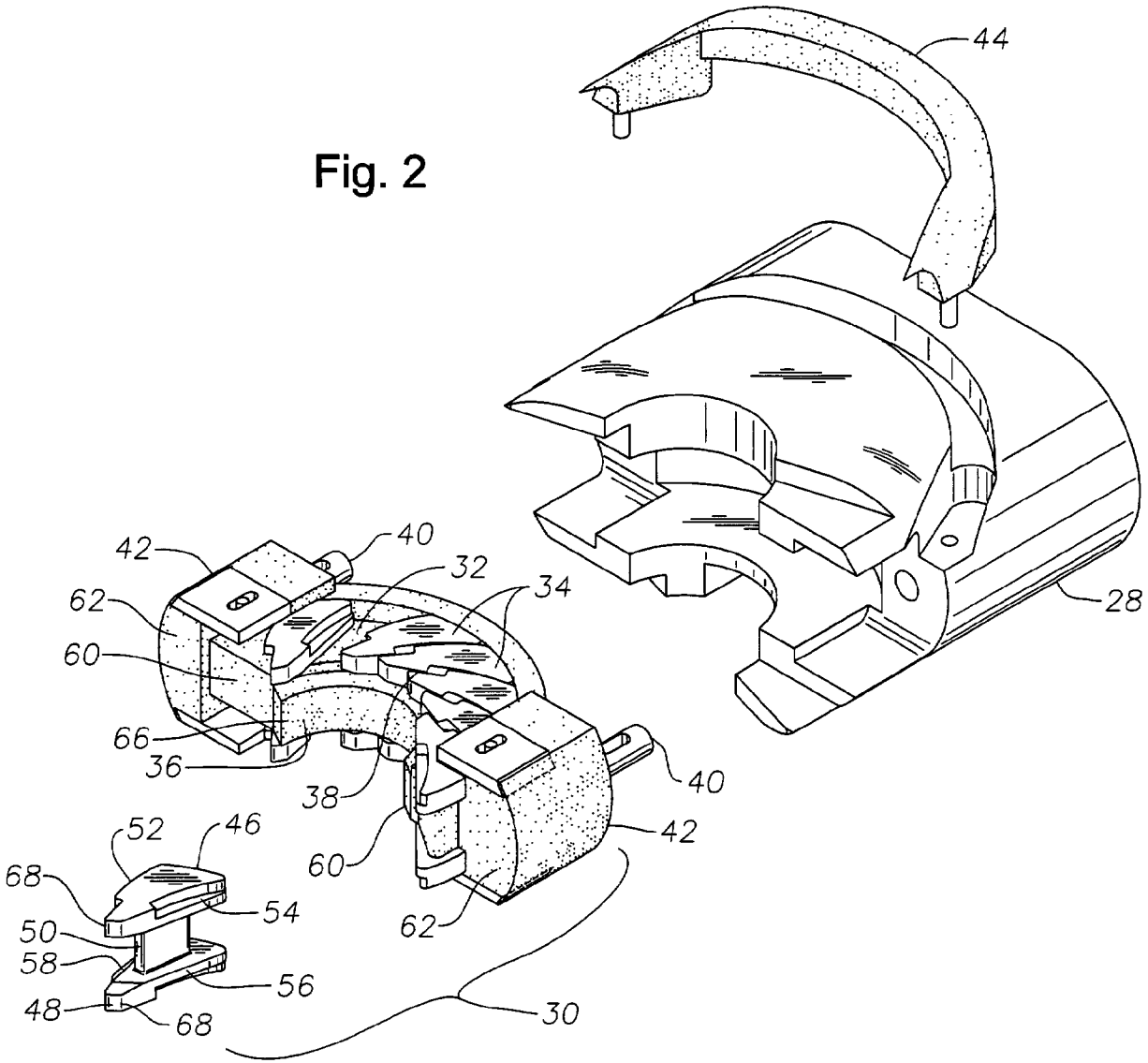
FIG. 2 is an exploded view of the variable bore ram packer of the present invention.

Variable bore ram packer 30 is shown in an exploded view in FIG. 2 to aid in understanding the relationship between the parts. Variable bore ram packer 30 includes packer member 32 of an elastomeric material with suitable rheological characteristics and packer inserts 34 molded into one unitary structure with packer inserts 34 arranged around a central semi-elliptical opening 36 to form an insert array 38 that is sized to fit closely about a tubular member. Packer pins 40 are molded into variable bore ram packer 30 for connecting variable bore ram packer 30 to ram 28. Packer member 32 is molded to form side block seals 42 on its lateral edges. Ram 28 includes top seal 44 on its upper face. Top seal 44 and side block seals 42 combine to seal ram 28 in guideways 16 of ram type blowout preventer 10 in a manner well known to those of ordinary skill in the art. When rams 28 are closed around a tubular member disposed in bore 14 of ram type blowout preventer 10, packer members 32 seal around the tubular member in a manner to be described more fully hereinafter.

As shown in FIG. 2, packer inserts 34 include top plate 46, bottom plate 48 and central web 50. Top plate 46 and bottom plate 48 are substantially triangular in shape with central web 50 positioned thereon. Central web 50 is integrally formed with top plate 46 and bottom plate 48 by suitable means as casting. Other means of forming packer insert 34 such as attaching central web 50 to top plate 46 and bottom plate 48 by welding are envisioned and within the scope of the present invention. Central web 50 is shown having a elongated rectangular cross section but differently shaped cross sections would be suitable provided they give sufficient bending strength to packer insert 34.

Top plate 46 and bottom plate 48 are mirror images of one another and include guide lip 52 and guide shoulder 54 formed on top plate 46 and guide lip 56 and guide shoulder 58 formed on bottom plate 48. Thus, when packer inserts 34 are molded into packer member 32, guide lips 52 and guide shoulders 54 of adjacent top plates 46 overlap. Similarly, guide lips 56 and guide shoulders 58 of adjacent bottom plates 48 overlap. Thus, as seen in FIG. 2, the assemblies of top plates 46 and bottom plates 48 are arranged to form semi-circular steel arcs similar to that of an "iris" shutter of a camera that acts to prevent extrusion of the elastomeric material of packer member 32 in use.

As best seen in FIG. 2, packer member 32 is molded into a semi-elliptical shape with a sealing face 60 at each edge, adjacent side block seals 42. On one side of packer member 32, sealing face 60 is inset, i.e., set back from front face 62 of packer member 32 or parting line 64 between opposing rams 28. Additionally, wedge protrusion 66 is formed on the sealing face 60 that is inset from front face 62 for purposes to be explained hereinafter. Top plate 46 and bottom plate 48 have tips 68 formed at the apex of one side of their substantially triangular shape.

Figure 3:
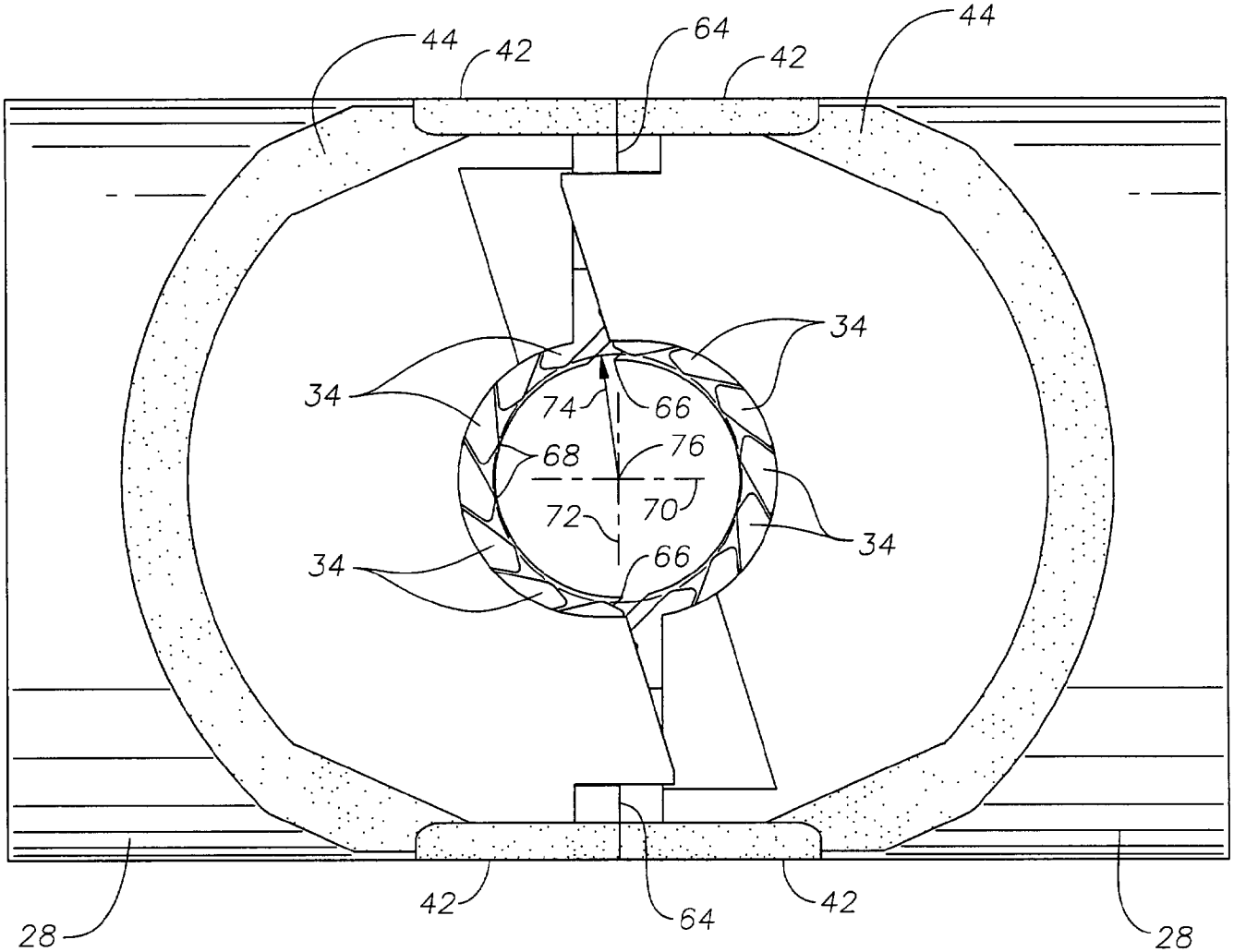
FIG. 3 is a plan view of a pair of variable bore ram packers of the present invention in the closed position.

As shown in FIG. 3, the semi-elliptical shapes of packer members 32 are oriented with their major axis 70 aligned with the direction of movement of rams 28 as they are moved between open and closed positions. Similarly, the minor axis 72 of packer members 32 are oriented perpendicularly with the direction of movement of rams 28 and coincident with parting line 64. When packer members 32 are molded with packer inserts 34, packer inserts 34 are arranged as shown in FIG. 3, with tips 68 in a semi-circular arrangement with their radius 74 having as its center 76, the intersection of major axis 70 and minor axis 72 of packer members 32. Thus, the elliptical shape of elastomeric packer members 32 has the same center 76 as the circular shape of tips 68 of packer inserts 34. It is this unique combination of shapes in combination with wedge protrusions 66 that increases mobility and movement of insert array 38 to ensure the packer inserts 34 smoothly and uniformly surround the pipe to be sealed against and eliminate large rubber extrusion gaps in the annulus between the metal insert's central column and the pipe being sealed against.

Figure 4:
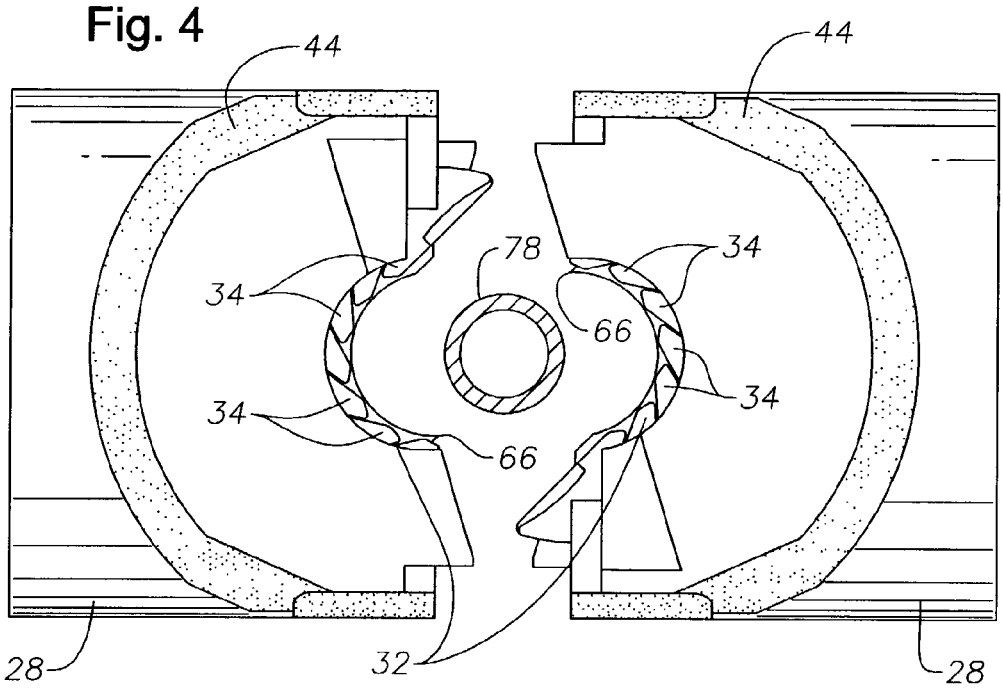
FIG. 4 is a plan view of a pair of variable bore ram packers of the present invention in the open position with a tubular member to be sealed against positioned therebetween.
Figure 5:
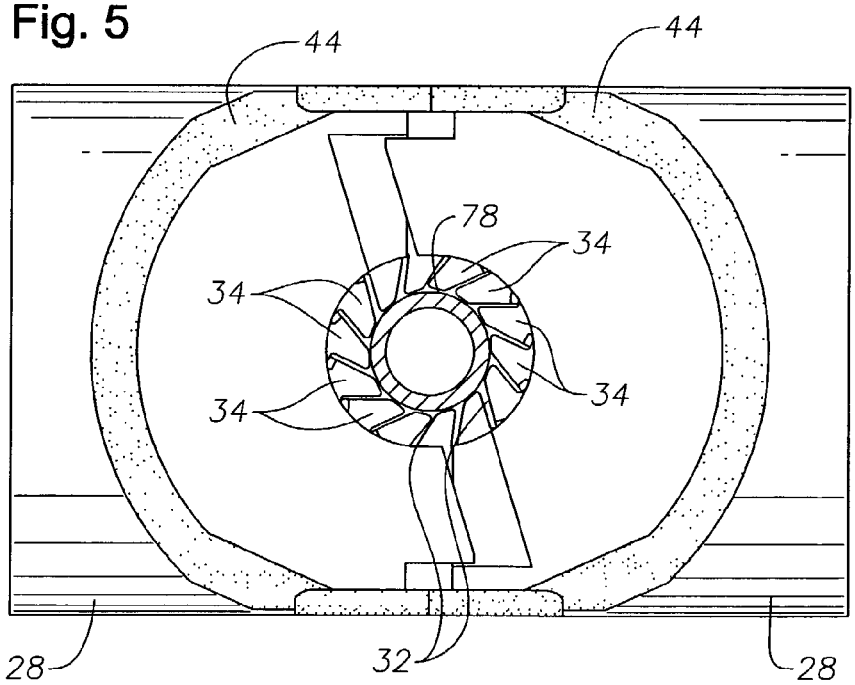
FIG. 5 is a plan view of a pair of variable bore ram packers of the present invention in the closed position sealing against a tubular member positioned therebetween.

This is seen more clearly in FIGS. 4 and 5 with drill pipe or similar tubular member 78 disposed between opposing rams 28. In the open position of FIG. 4, wedge protrusions 66 extend out from under the last packer insert 34 on opposite sides of packer members 32. Wedge protrusion 66 on each packer member 32 acts to engage the opposing ram packer 32 to provide a sliding action that reduces stress, elongation and strain in packer members 32 as packer members 32 are moved to their closed position of FIG. 5. Wedge protrusion 66 allows use of inset sealing face 60 which provides for engagement of packer inserts 34 prior to development of pressure in packer member 32.

The construction of our improved variable bore ram packer will be readily understood from the foregoing description and it will be seen that we have provided an improved variable bore ram packer that increases mobility and movement of the packer insert array to ensure the packer inserts smoothly and uniformly surround the pipe to be sealed against and eliminate large rubber extrusion gaps in the annulus between the packer insert's central web and the pipe being sealed against. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A variable bore packer used in a ram-type blowout preventer for oil and gas drilling operations, comprising:

a packer member molded of elastomeric material having a central semi-elliptical opening sized to fit closely about a tubular member upon closure of said blowout preventer;

a plurality of packer inserts molded within said elastomeric material to form an insert array having a central semi-circular opening;

said packer member and said insert array being molded into a unitary structure allowing said insert array to move and seat against different diameter tubular members to prevent extrusion of said elastomeric material between said packer inserts and the tubular member;

said central semi-elliptical opening of said packer member and said central semi-circular opening of said insert array having a common axis; and, said unitary structure is molded to form a pair of side block seals integral with said packer member.

2. A variable bore packer used in a ram-type blowout preventer for oil and gas drilling operations according to claim 1, wherein:

said packer member includes a sealing face at each edge of said central semi-elliptical opening; and, at least one of said sealing faces is inset from the front face of said packer member.

3. A variable bore packer used in a ram-type blowout preventer for oil and gas drilling operations according to claim 2, wherein:

said sealing face inset from the front face of said packer member includes a wedge protrusion to engage an opposing packer.

4. A variable bore packer used in a ram-type blowout preventer for oil and gas drilling operations according to claim 3, wherein:

said wedge protrusion of said inset sealing face engages a sealing face of a mating variable bore ram packer to allow movement of said packer inserts prior to development of pressure in said packer member.

5. A variable bore packer used in a ram-type blowout preventer for oil and gas drilling operations according to claim 4, wherein:

said packer inserts include a top plate, a bottom plate and a central web positioned therebetween; and, said top plate, said bottom plate and said central web are integrally formed.

6. A variable bore packer used in a ram-type blowout preventer for oil and gas drilling operations according to claim 5, wherein:

each of said top and bottom plates includes a guide lip and a guide shoulder; and, said plurality of packer inserts coact to provide an irising motion to move and seat against different diameter tubular members.

7. A variable bore packer used in a ram-type blowout preventer for oil and gas drilling operations according to claim 6, including:

a plurality of packer pins molded in said packer member to connect said variable bore packer to a ram-type blowout preventer.

8. A ram-type blowout preventer used in oil and gas drilling operations having a variable bore ram assembly, comprising:

a body with a vertical bore;

a pair of opposing bonnet assemblies laterally disposed in said body;

a pair of opposing variable bore rams laterally moveable within said bonnet assemblies;

said variable bore rams providing a seal around a tubular member having a diameter within a predetermined range, said tubular member disposed within said vertical bore upon closing of said variable bore rams;

said pair of variable bore rams each includes a ram body, a top seal and a packer member said packer member molded of elastomeric material having a central semi-elliptical opening sized to fit closely about a tubular member upon closure of said blowout preventer;

said packer member includes a plurality of packer inserts molded within said elastomeric material to form an insert array having a central semi-circular opening;

said packer member and said plurality of packer inserts being molded into a unitary structure allowing said insert array to move and seat against different diameter tubular members to prevent extrusion of said elastomeric material between said packer inserts and the tubular member;

said central semi-elliptical opening of said packer member and said central semi-circular opening of said insert array having a common axis; and, said unitary structure is molded to form a pair of side block seals integral with said packer member.

9. A ram-type blowout preventer used in oil and gas drilling operations having a variable bore ram assembly according to claim 8, wherein:

said packer member includes a sealing face at each edge of said central semi-elliptical opening; and, at least one of said sealing faces is inset from the front face of said packer member.

10. A ram-type blowout preventer used in oil and gas drilling operations having a variable bore ram assembly according to claim 9, wherein:

said sealing face inset from the front face of said packer member includes a wedge protrusion to engage an opposing packer insert array.

11. A ram-type blowout preventer used in oil and gas drilling operations having a variable bore ram assembly according to claim 10, wherein:

said wedge protrusion of said inset sealing face engages a sealing face of a mating variable bore ram packer to allow movement of said packer inserts prior to development of pressure in said packer member.

12. A ram-type blowout preventer used in oil and gas drilling operations having a variable bore ram assembly according to claim 11, wherein:

said packer inserts include a top plate, a bottom plate and a central web positioned therebetween; and, said top plate, said bottom plate and said central web are integrally formed.

13. A ram-type blowout preventer used in oil and gas drilling operations having a variable bore ram assembly according to claim 12, wherein:

each of said top and bottom plates includes a guide lip and a guide shoulder; and, said plurality of packer inserts coact to provide an irising motion to move and seat against different diameter tubular members.

14. A ram-type blowout preventer used in oil and gas drilling operations having a variable bore ram assembly according to claim 13, including:

a plurality of packer pins molded in said packer member to connect said variable bore packer to a ram-type blowout preventer.

* * * * *